US010709274B2

(12) United States Patent
Shouse

(10) Patent No.: US 10,709,274 B2
(45) Date of Patent: Jul. 14, 2020

(54) BRACELET MOUNT AND CLASP POSITIONING DEVICE

(71) Applicant: Tommy H. Shouse, Bardstown, KY (US)

(72) Inventor: Tommy H. Shouse, Bardstown, KY (US)

( * ) Notice: Subject to any disclaimer, the term of this patent is extended or adjusted under 35 U.S.C. 154(b) by 0 days.

(21) Appl. No.: 16/025,463

(22) Filed: Jul. 2, 2018

(65) Prior Publication Data

US 2019/0008301 A1 Jan. 10, 2019

Related U.S. Application Data

(60) Provisional application No. 62/527,254, filed on Jun. 30, 2017.

(51) Int. Cl.
*A47G 25/90* (2006.01)
*A44C 5/00* (2006.01)

(52) U.S. Cl.
CPC ..... *A47G 25/901* (2013.01); *A44C 5/0053* (2013.01)

(58) Field of Classification Search
CPC ..... A47G 25/901; A44C 5/0053
USPC ..... 248/121, 122.1, 317, 688, 519, 176.1
See application file for complete search history.

(56) References Cited

U.S. PATENT DOCUMENTS 587,246 A * 7/1897 Stuart ..... A47G 25/905 223/111
2,896,890 A * 7/1959 Hlavac ..... A47G 25/901 248/122.1
2,926,875 A 3/1960 Hoye
3,016,589 A 1/1962 Collins
4,095,362 A * 6/1978 Potter ..... B42F 15/00 248/317
5,405,066 A 4/1995 Fakier
5,709,327 A * 1/1998 LaMacchia ..... A44C 5/00 223/111
5,899,369 A 5/1999 Macripo
5,934,526 A 8/1999 Rosenbaum
6,036,065 A 3/2000 Wofford
6,095,346 A * 8/2000 Idelberger ..... A47G 25/901 211/85.2
6,112,958 A 9/2000 LaMacchia
6,158,578 A * 12/2000 Greiner ..... A47F 5/10 206/6.1
6,484,910 B1 11/2002 Korkos
6,578,397 B1 6/2003 Altrich
7,284,684 B1 10/2007 Gharavi
7,712,643 B2 5/2010 Papernik
(Continued)

*Primary Examiner* — Muhammad Ijaz
(74) *Attorney, Agent, or Firm* — Carrithers Law Office, PLLC; David W. Carrithers

(57) ABSTRACT

A mounting device for holding a selected distal end of a bracelet having opposing joining members of a clasp in a selected position in order for an individual to fasten a cooperative portion of the clasp connecting the two ends of a bracelet on the wrist. The device includes a base with a bendable or formable elongated member such as a wire extending from the base. The free end of the wire has a holding mean such as a clip for removably holding a selected first end of the bracelet while the user aligns and positions the opposing second end portion of the clasp and joins or attaches them together. The holding members or jaws of the clip can be covered with a resilient material for holding the bracelet without scratching.

16 Claims, 4 Drawing Sheets

(56) References Cited

U.S. PATENT DOCUMENTS

| | | | | |
|---|---|---|---|---|
| 7,721,924 | B2 | 5/2010 | McCluhan | |
| 7,870,981 | B2 | 1/2011 | Ionis | |
| 8,281,966 | B2 | 10/2012 | Rodgers | |
| 8,375,585 | B1 | 2/2013 | Sittler | |
| 2010/0327128 | A1* | 12/2010 | Carnevali | E04H 12/20 248/121 |
| 2011/0180573 | A1* | 7/2011 | Rodgers | A47G 25/901 223/111 |
| 2015/0230565 | A1 | 8/2015 | Fuhrman | |
| 2016/0089768 | A1 | 3/2016 | Kimura | |

* cited by examiner

BRACELET MOUNT AND CLASP POSITIONING DEVICE

CROSS REFERENCES TO RELATED APPLICATIONS

This application claims priority from U.S. Provisional application Ser. No. 62/527,524 filed on Jun. 30, 2017 and is incorporated by reference herein in its entirety.

TECHNICAL FIELD

The present invention relates to the field devices used to help a user connect the two ends of a bracelet together on the user's wrist.

BACKGROUND OF THE INVENTION

A common article of jewelry worn by women is ornamental bracelets consisting of a flexible band or chain with a loop or chain link at one end and a separate fastener or clasp at the other end which is fastened to the loop or link after the bracelet has been placed around the wrist. There are various kinds of bracelet fasteners or clasps but most of them include a loop-like section or a chain link at one end of the wrist band while at the other end of the bracelet contains a spring loaded pivoted hook section that must be held open while the free end of the hook is passed through the loop and then released to hold the hook fast in the loop. It is extremely difficult to bring these two parts into alignment to connect them by the use of one hand while the bracelet band extends around the wrist of the other hand. Consequently, the wearer usually asks another person to fasten the bracelet or at least hold one of the clasp sections steady while the other section is being engaged with it.

Most ornamental bracelets worn by women consist of a flexible band or chain and a separate fastener or clasp which is closed after the bracelet has been placed around the wrist. These bracelet fasteners or clasps are of various kinds but most of them include a loop-like section at one end of the wrist band or chain while at the other end of the latter is a pivoted tongue-like section that must be passed through the loop and then snapped to a closed position. It is extremely difficult to bring the two parts or elements of the clasp into an engaged and closed position by the use of one hand while the bracelet band extends around the wrist of the other hand; and usually the wearer requests another person to fasten the bracelet or at least hold one of the clasp sections steady while the other section is being engaged with it.

SUMMARY OF THE INVENTION

A mounting device for holding a selected distal end of a bracelet having opposing joining members of a clasp in a selected position in order for an individual to fasten a cooperative portion of the clasp connecting the two ends of a bracelet on the wrist. The device includes a base with a bendable or formable elongated member such as a wire extending from the base. The free end of the wire has a holding mean such as a clip for removably holding a selected first end of the bracelet while the user aligns and positions the opposing second end portion of the clasp and joins or attaches them together. The holding members or jaws of the clip can be covered with a resilient material for holding the bracelet without scratching.

The term wire generally refers to solid wire, also called solid-core or single-strand wire which consists of one piece of metal wire; however, the longitudinal support member in the present invention may be comprised of a bundle strands, as in "multistranded wire" or other polymeric material which when bent tends to retain its shape and is formable. Often polymer coated wire or insulated wire can be used to provide structural support and is formable. The longitudinal support member or wire must be able to be bent in various selected configurations and hold its shape or form. It is desirable that the material can be bent repeatably providing an adjustable support member in the x, y, and z axis.

In the present invention the wire longitudinal support member comprises a generally vertical bottom portion having a curved upper portion for supporting a holding means such as an alligator clip which extends at a right angle from the distal end of the longitudinal member. Thus, the tip of the longitudinal member extends away from the base and the clip jaws are spaced apart from the longitudinal support member.

Wire comes in solid core, stranded, or braided forms. Although usually circular in cross-section, wire can be made in square, hexagonal, flattened rectangular, or other cross-sections, either for decorative purposes, or even formed in a coil.

In accordance with the present invention, there is provided a bracelet mount and clasp positioning device comprising, consisting of, or consisting essentially of a base having a bottom surface and a top surface with connecting side surfaces. At least one central post member extends 10 upward from a top surface of the base member to support a generally a horizontal, cylindrical display member affixed to a top surface of the post member forming a "T". An axis of the cylindrical member is horizontal and the cylindrical display member is centered on the top surface of the post member providing support for a plurality of bracelets, necklaces, or jewelry. A bendable or formable elongated member is a semi-rigid member such as a wire extends from the horizontal cylindrical display member. The wire 15 member is of sufficient stiffness to hold its shape or position when bent to a particular configuration. The bendable longitudinal member provides a guide for spacer and positioning means such as beads or other items of a selected size having throughbores to be coaxially mounted on the longitudinal member. The beads or other positioning means limit the amount of curvature or movement of the longitudinal member providing positional support therefor. A holding means such as a clamp, 20 magnet, hook or alligator clamp is fixedly connected to a free distal end of the bendable, stiff wire. The alligator clamp has two opposing jaws which are urged against one another by a spring, the jaws being forced apart when two operable arms of the clamp are urged together, the two jaws covered by a protective, resilient material.

One object of the invention is to provide a simple and effective device which may be supported on a table or the like and which will hold one clasp section of a bracelet band steady while the coacting clasp section is being fastened to it.

Another object is to provide a device of this character which includes a base to support the wrist to which the bracelet is to be applied, a clamp to hold one of the bracelet clasp sections and a standard to support the clamp over the base and the forearm or wrist so that the user's other hand may quickly and easily position the bracelet around the wrist and engage and fasten the other clasp section to the one held by the clamp.

It is an object of this invention to provide a bracelet attachment aid which employs a stiff, bendable wire extending upward from a base member with a alligator clamp fixed at the free end of the wire wherein the clamp is use to hold the loop or chain link at one end of a bracelet while the user wraps the bracelet around one wrist and uses the opposite hand to open the spring loaded hook and insert the hook into the loop or chain link.

It is an object of this invention to provide a bracelet attachment aid which employs a stiff, bendable wire extending upward from a base member with an alligator clamp fixed at the free end of the wire wherein the wire is capable of being bent to the shape desired by the individual user, thus allowing the clamp to be positioned at any desired angle, height, or position desired, as opposed to other attachment aids with fixed arms which can hold the bracelet in only one position with respect to the base member.

It is an object of this invention to provide a bracelet attachment aid which employs a stiff, bendable wire extending upward from a base member with a alligator clamp fixed at the free end of the wire wherein the jaws of the alligator clamp are covered with resilient material to protect the bracelet parts.

It is an object of this invention to provide a bracelet attachment aid which employs a stiff, bendable wire extending upward from a base member wherein the base member includes horizontal cylindrical arms covered with a velour like material so that the user may hang bracelets over the arms for display and comparison purposes.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
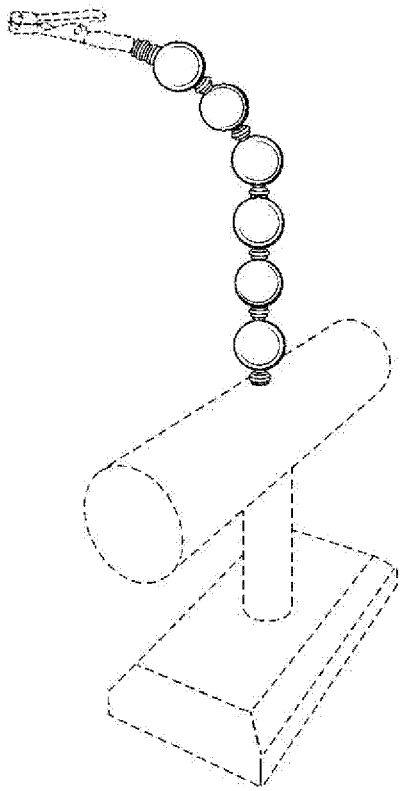
FIG. 1 is a perspective view of the bracelet mount and attachment device showing the positionable extendable longitudinal member curved normal to the base.
Figure 2:
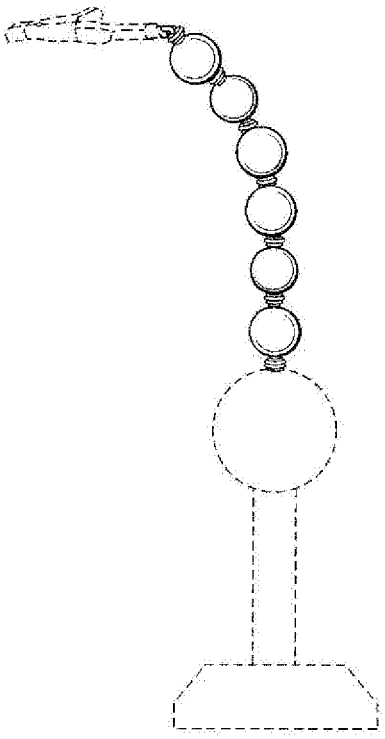
FIG. 2 is a right side view of FIG. 1.
Figure 3:
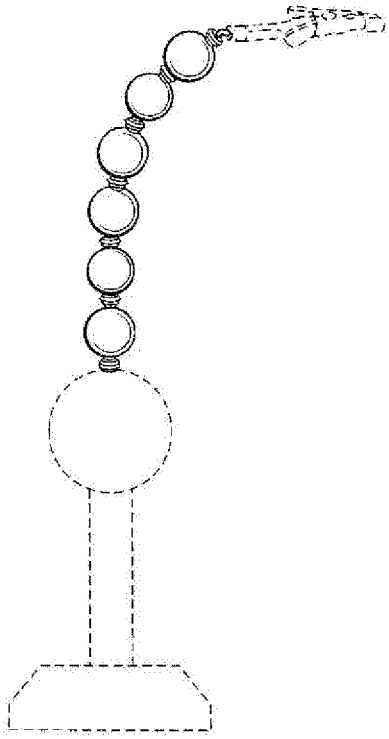
FIG. 3 is a left side view of FIG. 1.

In accordance with the present invention, there is provided a bracelet attachment aid 10 including a base member 12, a vertical post member 16 extending upward from the center of the top surface of the base member 12, a horizontal cylindrical bracelet display member 14 situated on the top of the vertical post member 16, a bead covered wire support member 20 extending upward from the center of the top surface of the display member 14, and a fastening means such as an alligator clamp 22 is fixed to the free end of a resilient flexible and bendable member having memory such as a wire 20. The jaws of the alligator clamp 22 are covered with a resilient material 26 to protect the bracelet from damage while the bracelet is held in the clamp during use.

The bendable, stiff wire 20 is fixedly connected to the top center of the cylindrical display member 14 and extends upward therefrom. The wire 20 is adorned with beads 18 of various sizes, shapes and colors which are impaled on the wire and which limit the angle to which the wire can be bent, thus protecting the wire from sharp bends and kinks which could damage or distort the wire. Consequently, the size of the beads is selected as desired based on the desired limitation of bending, wherein, larger beads will limit the bending angles more than will smaller beads, and thus, larger beads may be more desirable to further protect the wire.

One embodiment of the present invention contains a segmented flexible arm rather than a bendable wire 20 for holding the alligator clamp. Other embodiments of the present invention include a velour type material covering the base member 12, the post 16 and the cylindrical display member 14.

Figure 4:
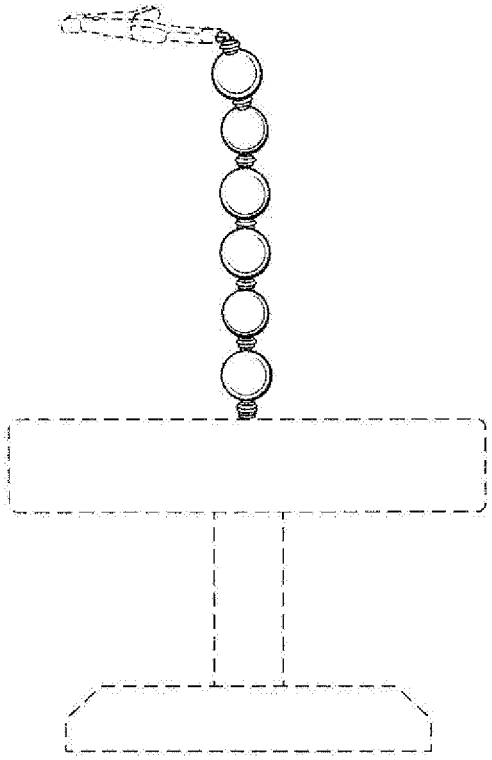
FIG. 4 is a rear view of FIG. 1.
Figure 5:
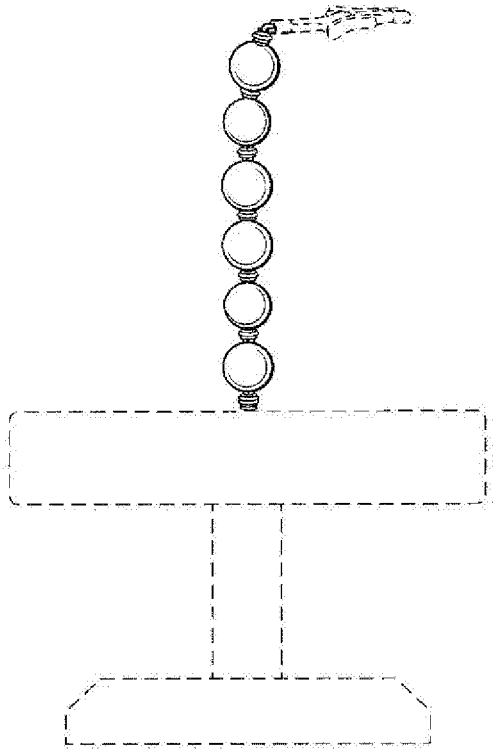
FIG. 5 is a front view of FIG. 1.
Figure 6:
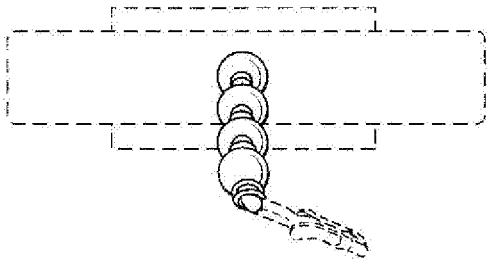
FIG. 6 is a top view of FIG. 1.
Figure 7:
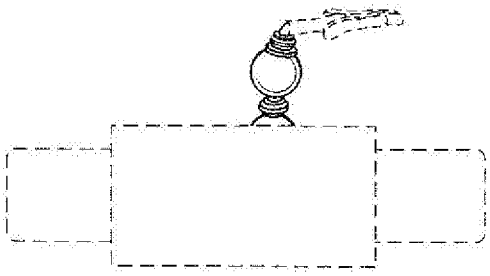
FIG. 7 is a bottom view of FIG. 1.
Figure 8:
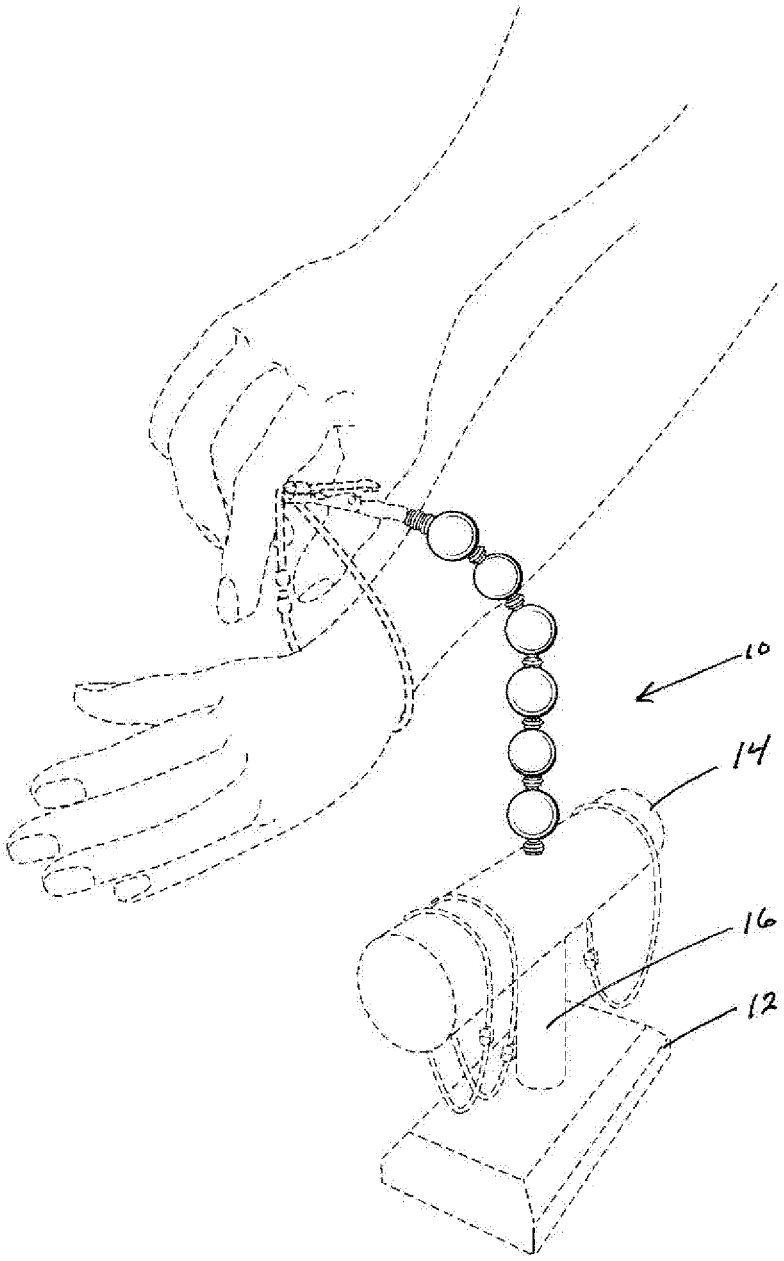
FIG. 8 is a perspective view of the device wherein a user is shown in phantom or broken lines using the device to support a bracelet.
Figure 9:
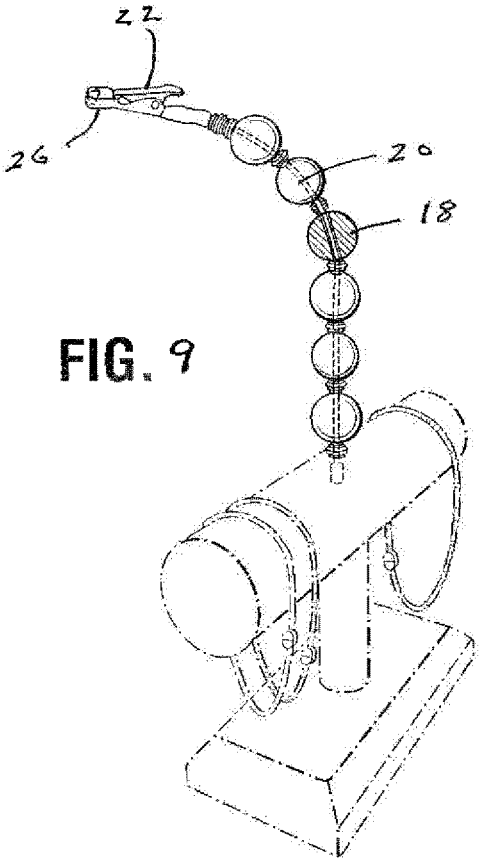
FIG. 9 is a perspective view showing the details of the clasp holding means and bead spacing and positioning means.
Figure 10:
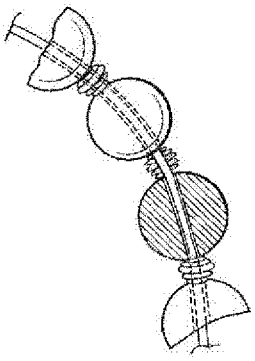
FIG. 10 is an enlarged view of a portion of FIG. 9 showing the bead spacing and positioning means.
Figure 11:
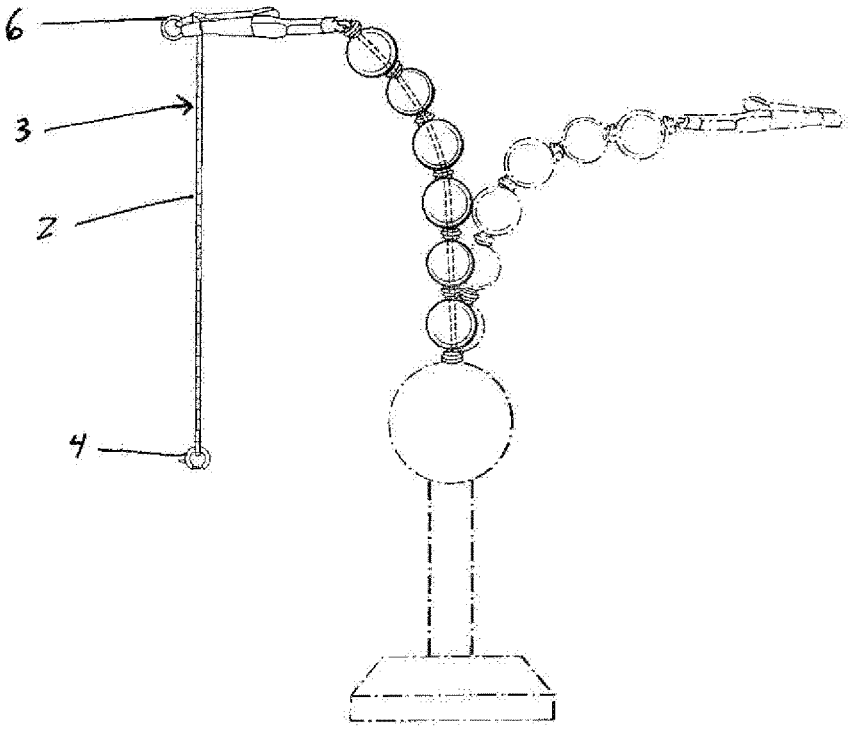
FIG. 11 is a perspective view of the bracelet mount and attachment device showing the positionable extendable longitudinal member supporting a clasp holding means extending outward therefrom holding a distal end of a bracelet in position for attachment of the cooperatively engageable clasp thereto.

As can be seen in FIG. 4, the flexible wire 20 may be adjusted to more desirable positions which may suit the user and provide a more comfortable position in which the bracelet is to be held. Positions 30 and 32 are exemplary positions wherein the alligator clamp is tilted as desired and is stationed at a chosen height and a chosen lateral distance from the base member 12.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims. Accordingly, this invention is not intended to be limited by the specific exemplification presented herein above. Rather, what is intended to be covered is within the spirit and scope of the appended claims.

I claim:

1. A bracelet attachment aid comprising:

a stationary base member having a bottom surface, a top surface, and a plurality of lateral surfaces;

a post member extending upward from a central point of said top surface of said stationary base member;

a display member mounting on said post member, said display member comprising a pair of horizontal arms extending from opposing sides of said post member for supporting bracelets thereon;

a single bendable semi-rigid wire member extending upward from a center of said display member in alignment with said post member;

said single bendable semi-rigid wire member is surrounded with a plurality of coaxial beads each one including a curved end portion abutting one another limiting arcuate movement of said single bendable semi-rigid wire member; and an alligator clamp fixedly connected to a free end of said single semi-rigid wire member, said alligator clamp having two opposing jaws urged against one another by a spring, said two opposing jaws being forced apart when two operable arms extending from opposing ends of said alligator clamp are urged together, said two opposing jaws covered by a protective, resilient material.

2. The bracelet attachment aid of claim 1, said plurality of coaxial beads including at least one coaxial spacer bead, of a different size.

3. The bracelet attachment aid of claim 1, wherein said single bendable semi-rigid wire member is selected from the group consisting of a multi-stranded wire, a polymer coated wire, a solid core wire, a braided wire, and an insulated wire.

4. The bracelet attachment aid of claim 1, wherein said single bendable semi-rigid wire member holds its form upon bending in various selected configurations.

5. A bracelet attachment aid comprising:

a stationary base member having a bottom surface, a top surface, and a plurality of lateral surfaces;

a post member extending upward from a central point of said top surface of said stationary base member;

a display member mounting on said post member, extending from opposing sides of said post member for supporting at least one bracelet thereon;

a bendable semi-rigid member extending upward from a center of said display member in axial alignment with said post member;

said bendable semi-rigid member is surrounded with a plurality of coaxial beads abutting one another limiting arcuate movement of said bendable semi-rigid member; and holding means for securing a distal end of a selected bracelet, said holding means fixedly connecting to a free end of said bendable semi-rigid member.

6. The bracelet attachment aid of claim 5, wherein said holding means comprises a clamp having two opposing jaws urged against one another by a spring, said two opposing jaws being forced apart when two operable arms extending from opposing ends of said clamp are urged together, said two opposing jaws covered by a protective, resilient material.

7. The bracelet attachment aid of claim 5, wherein said display member comprises a pair of horizontal arms extending from said post member.

8. The bracelet attachment aid of claim 5, said plurality of coaxial beads including at least one spacer bead of a selected different size.

9. The bracelet attachment aid of claim 5, wherein said bendable semi-rigid member is selected from the group consisting of a multi-stranded wire, a polymer coated wire, a solid core wire, a braided wire, and an insulated wire.

10. The bracelet attachment aid of claim 5, wherein said bendable semi-rigid member holds its form upon bending in various selected configurations.

11. A bracelet attachment aid comprising:

a stationary base member having a bottom surface, a top surface, and a plurality of lateral surfaces;

a post member extending upward from a central point of said top surface of said stationary base member;

a display member mounting on said post member, extending from opposing sides of said post member for supporting at least one bracelets thereon;

a bendable semi-rigid member extending upward from a center of said display member in axial alignment with said post member;

said bendable semi-rigid member surrounded with a plurality of coaxial beads each one abutting one another limiting arcuate movement of said bendable semi-rigid member, including at least one spacer bead of a selected different size and holding means for securing a distal end of a selected bracelet, said holding means fixedly connected to a free end of said bendable semi-rigid member.

12. The bracelet attachment aid of claim 11, wherein said holding means comprises a clamp having two opposing jaws urged against one another by a spring, said two opposing jaws being forced apart when two operable arms extending from opposing ends of said clamp are urged together, said two opposing jaws covered by a protective, resilient material.

13. The bracelet attachment aid of claim 11, wherein said display member comprises a pair of horizontal arms extending from said post member.

14. The bracelet attachment aid of claim 11, wherein a size of each of said coaxial beads and said spacer bead is selected based on a desired limitation of bending.

15. The bracelet attachment aid of claim 11, wherein said bendable semi-rigid member is selected from the group consisting of a multi-stranded wire, a polymer coated wire, a solid core wire, a braided wire, and an insulated wire.

16. The bracelet attachment aid of claim 11, wherein said bendable semi-rigid member wire member holds its form upon bending in various selected configurations.

* * * * *